United States Patent [19]

Albin

[11] 4,344,551

[45] Aug. 17, 1982

[54] TRANSPORTABLE APPARATUS FOR CUTTING AND DISPENSING ROLL MATERIAL

[75] Inventor: Michael J. Albin, Miami, Fla.

[73] Assignee: Equipment Company of America, Hialeah, Fla.

[21] Appl. No.: 161,105

[22] Filed: Jun. 19, 1980

[51] Int. Cl.[3] ..... B26F 3/02; B26D 1/02

[52] U.S. Cl. ..... 225/86; 225/89; 225/77; 83/614; 83/526; 83/582; 83/649; 83/859

[58] Field of Search ..... 83/455, 524, 526, 527, 83/563, 582, 614, 648, 649, 650, 658, 698, 859; 225/77, 80, 85, 86, 89; 242/73; 269/254 CS

[56] References Cited

U.S. PATENT DOCUMENTS

| | | | |
|---|---|---|---|
| 600,333 | 3/1898 | Meeker | 242/73 |
| 1,745,379 | 2/1930 | Perry | 269/254 CS |
| 2,654,544 | 10/1953 | Pusheck | 225/77 |
| 2,862,676 | 12/1958 | Castelli | 83/649 X |
| 3,072,000 | 1/1963 | Bracey et al. | 83/649 X |
| 3,419,201 | 12/1968 | Brandon | 83/649 X |
| 3,540,337 | 11/1970 | Gardner | 83/614 X |
| 3,788,175 | 1/1974 | Davis | 83/614 X |
| 3,987,603 | 10/1976 | Jelling et al. | 225/4 X |
| 4,196,647 | 4/1980 | Fish | 83/649 X |

*Primary Examiner*—Frank T. Yost
*Assistant Examiner*—Robert P. Olszewski
*Attorney, Agent, or Firm*—Cullen, Sloman, Cantor, Grauer, Scott & Rutherford

[57] ABSTRACT

An apparatus for transporting, cutting and dispensing heavy web sheet material such as cardboard, plastic film and the like, while in roll form. The apparatus includes a manually wheelable frame that can be selectively raised and lowered by a retractable handle at its rearward end to support the frame on a pair of front wheels for transporting the roll to the jobsite. Lowering the apparatus onto fixed rear legs supports the frame in a rest position for cutting and dispensing the sheet material. The frame has upright front and rear standards mounted in asymmetrical opposed relation on one side of the longitudinal center line of the frame. Thus, the roll is readily mounted in a stabilizing manner substantially along the frame center line by means of its roll axle shaft being supported on the inboard side of the standards. A cutting table extends between the upper ends of the standards, pivotally supporting a retainer brake for gravitational biased movement into edge engagement with the table bearing surface with the interposed sheet material retained thereon. A pivotal cutting blade, co-extensive with the retainer brake, is resiliently biased in a snap-action overcenter manner to retain the blade in either an overcenter raised dispensing position, to allow ready controlled withdrawal of material from the roll, or to an overcenter lowered cutting position with the cutting blade edge contacting the sheet material with the retainer brake holding the sheet firmly while being torn or cut with a knife, using the cutting blade edge as a guide. If used in this manner the cutting table would be provided with a wood board, a composition board, or similar surface.

10 Claims, 5 Drawing Figures

TRANSPORTABLE APPARATUS FOR CUTTING AND DISPENSING ROLL MATERIAL

BACKGROUND OF THE INVENTION

Various types of cardboard or paper cutters and dispensers have been employed for the general purpose of enabling the cutting and dispensing of heavy web sheet material while in roll form. In general, prior transportable cutters have been unsuccessful in that they have been inconvenient or difficult to use. Thus, there has been need for an effective transportable heavy roll cutter and dispenser which is simple to use, relatively inexpensive, while permitting one person to easily operate the device.

Among the problems encountered is that prior attempts to provide a wheelable cutter and dispenser have resulted in an unstable apparatus either during a transporting mode or during a cutting and dispensing mode of operation, or both. One cause of such instability results from the roll being mounted in an elevated manner to provide either an excessively high center of gravity or else the roll being mounted in an off-center orientation.

Another problem encountered during their cutting mode is the inability to maintain uniform tension control on the web of sheet material during the cutting or tearing operation and particularly when the roll has been reduced in diameter.

Another problem which commonly arises is providing a proper sheet feeding angle when withdrawing the material from a full roll that insures ease of operation without requiring excessive tension on the web and possible tipping of the apparatus.

Still another problem with prior cutting and dispensing apparatus is the difficulty in readily replacing a new roll of material and especially rolls of heavy sheet material such as cardboard, plastic film and the like.

A further disadvantage with prior cutting and dispensing apparatus is the inability to hold the sheet material firmly on the cutting table bearing surface during tearing, while preventing the sheet cut end from slipping off the table.

Thus, the invention herein relates to cutting and dispensing of roll form material and to a manually transportable or wheelable cutting and dispensing apparatus for sheet material while in roll form which solves the foregoing problems.

SUMMARY OF THE INVENTION

The invention herein contemplates an improved cutting and dispensing apparatus for roll form material that is easy to transport to the jobsite while allowing the user to readily and cleanly tear off the exact amount of corrugated cardboard, plastic film and the like required while in roll form. In general, the apparatus comprises a rectangular base frame having a pair of longitudinally extending side beams and front and rear cross beams with each cross beam having an upright standard mounted thereon. Wheels are positioned at opposite sides of the frame in spaced relation with the front cross beam whilesupport legs are provided on the rear cross beam. A retractable handle is carried adjacent the upper end of the rear upright standard for selectively raising and lowering the support legs to assume a first wheelable position and a second rest position for cutting and dispensing.

The upright standards are arranged in asymmetrical opposed relation on one side of the longitudinal center line of the frame with a cutting table assembly extending between the upper end of the standards of the frame. A sheet roll axle shaft is longitudinally disposed on the inboard side of the front and rear standards to thereby support the roll in the space therebetween with the shaft axis substantially aligned on the frame centerline. This arrangement provides a stable, low center of gravity apparatus during both its wheeling mode and its cutting and dispensing mode of operation.

The upper cutting and dispensing table assembly pivotally supports a sheet retainer brake on a longitudinally aligned axis co-extensive with the table upper bearing surface. The retainer brake is gravitationally biased to pivot towards a lead-in feed edge of the bearing surface for engagement with the bearing surface with the sheet material held therebetween. Pivotal plate means including a cutting blade, is spring biased to pivot about a longitudinally aligned axis providing snap-action movement in either an over center raised position to allow ready withdrawal of material from the roll to an over center lowered position with a cutting blade edge biased into contact with the bearing surface to cleanly tear off the exact amount of sheet material needed.

One of the objects of the present invention is to provide an apparatus for transporting, cutting and dispensing heavy web sheet material that is easily operated by one person. This is accomplished by locating the heavy roll of sheet material on the frame of the apparatus so as to be aligned substantially on the longitudinal centerline thereof. The roll may be easily loaded between a sidewardly open space defined between front and rear longitudinally aligned, asymmetrically positioned standards on the frame. Means are provided on the inboard side of the standards to receive and support opposite ends of a roll axle shaft.

The tubular roll supporting axle shaft has releasable coupling means that allows the axle to be readily separated and joined in a telescoping latching manner to reduce the overall length thereof for shipping purposes.

Another object of the invention is to provide an apparatus for cutting and dispensing heavy sheet material as set forth above having a wheelable frame with a pair of wheels being supported on the frame aligned on a transverse axis spaced from the front end of the frame. The frame has a retractable handle located adjacent the upper end of the rear standard allowing the frame to be selectively raised for support on the wheels to transport the heavy roll. In its lowered or rest position, the apparatus provides a stable cutting and dispensing apparatus for rolled sheet material readily usable by one person.

Another object of the invention is to provide an apparatus for cutting and dispensing heavy rolls of sheet material wherein a retaining brake is gravitationally biased for pivotal movement towards a tensioning lead-in feeding edge of the bearing surface over which the sheet material is drawn from the roll at an acute feed angle. The retainer brake is pivotally movable into edge engagement with the upper bearing surface with the sheet material firmly held therebetween while being torn by the cutting edge, preventing the cut end of the sheet from falling onto the floor.

Another object of the invention is to provide an apparatus for cutting and dispensing sheet material from a roll as set forth above having a pivotal cutting blade resiliently biased for snap-action movement to retain the blade in either a first over center raised position to allow ready controlled tension withdrawal of the material from the roll at a predetermined maximum acute pull angle substantially equal to the maximum acute feed angle. The cutting table bearing surface has a rolled lead-in edge porition over which the sheet material is drawn with the sheet inclined upwardly toward the edge at a predetermined maximum acute feed angle with the vertical when a full or maximum radius roll is on the roll shaft. As the feed angle is reduced progressively increased pre-tensioning drag on the sheet material compensates for the diminishing weight of the roll.

These and other objects and advantages of the invention will become apparent, upon reading the following description of which the attached drawings form a part.

DETAILED DESCRIPTION

Figure 1:
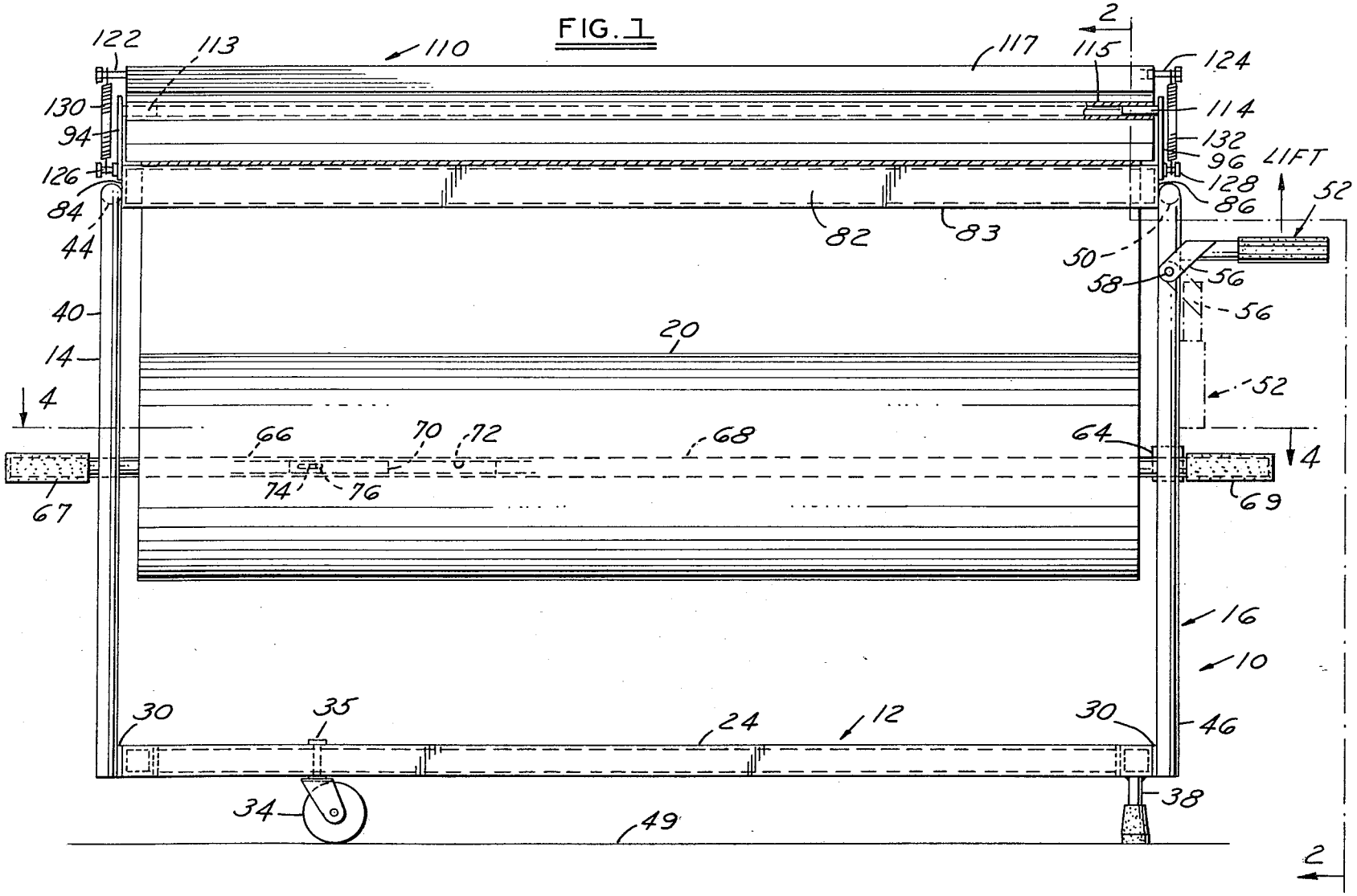
FIG. 1 is a side elevational view of the apparatus with parts broken away to show details thereof.
Figure 2:
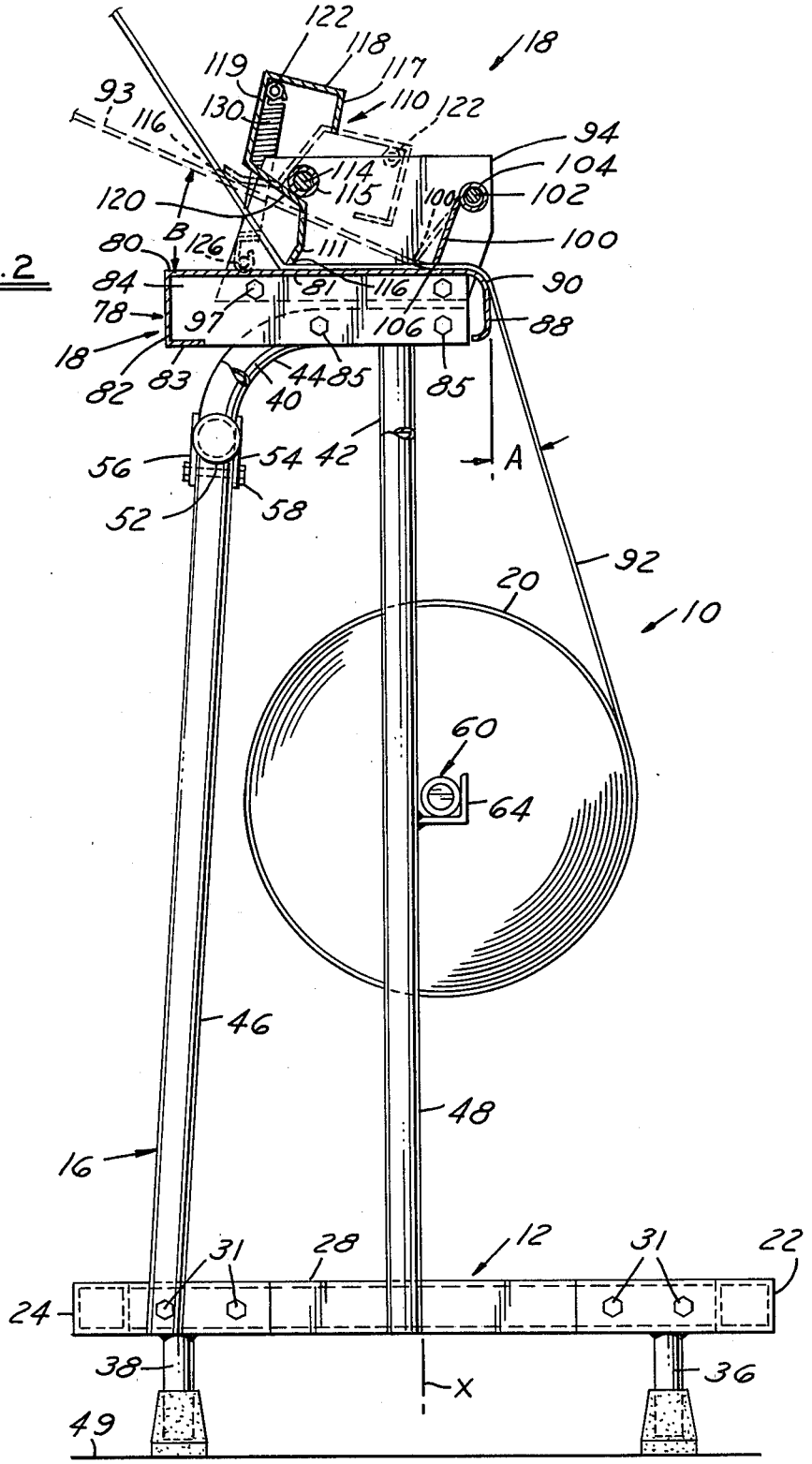
FIG. 2 is an end elevational view of the apparatus with the upper cutting table assembly shown in vertical section.

Referring to FIGS. 1 and 2, there is shown at 10 an apparatus for storing, transporting, cutting and dispensing heavy web sheet material which includes a rectangular base frame generally indicated at 12 supporting front and rear vertical upstanding standards 14 and 16, respectively, at each end. The apparatus further includes an upper cutting table assembly generally indicated at 18 extending between the upper ends of the front and rear standards.

Figure 4:
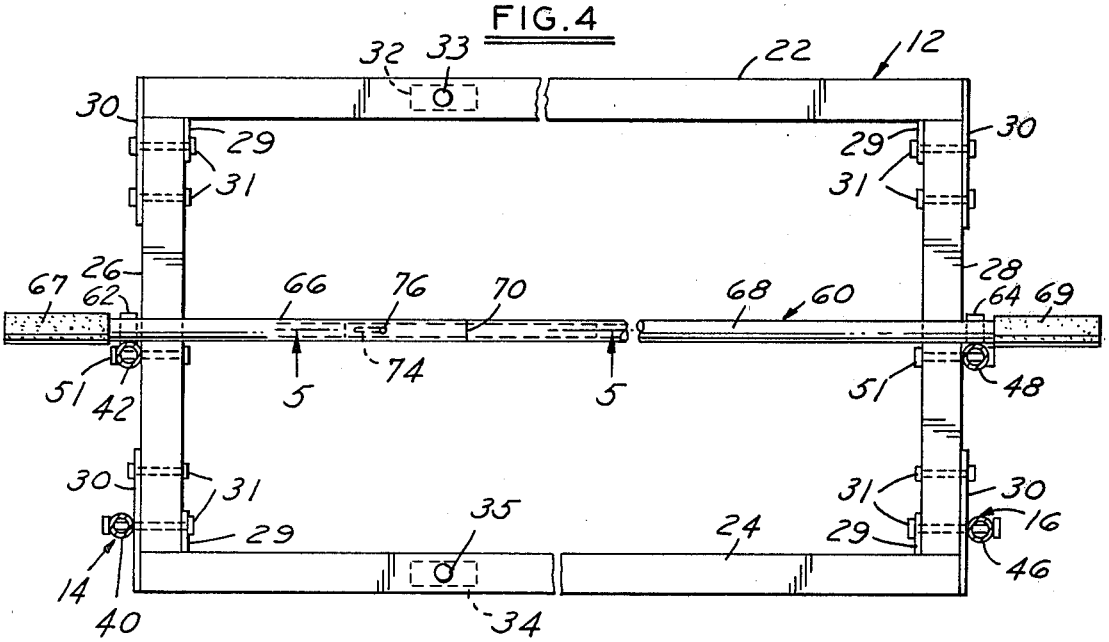
FIG. 4 is a horizontal sectional view taken substantially on the line 4—4 of FIG. 1.

As best seen in FIG. 4, the base frame 12 includes first and second side beams 22 and 24 respectively interconnected at their front ends by first cross beam 26 and interconnected at their rear ends by a second rear cross beam 28. The base frame is suitably secured together as by welding and is additionally reinforced by inner corner plates 29 and outer corner plates 30 secured to the frame cross beams by suitable means such as tie bolts 31.

As shown in FIGS. 1 and 4, a pair of support wheels or casters are mounted on each side beam with the casters located on a common transverse axis spaced a predetermined distance from the front cross beam 26. The caster wheel 32 is shown mounted on side beam 22 by means of a stud 33 and a support wheel 34 is shown mounted on side beam 24 by stud 35. As shown the unit is transported like a wheelbarrow by lifting the back end and rolling on the wheels 32 and 34. When used in this manner the wheels 32 and 34 cannot swivel. In certain applications, the unit could be provided with a pair of swivel wheels and a pair of rigid wheels. In other applications no wheels will be utilized. Rear support means in the form of a pair of support members or legs are shown in FIGS. 1 and 2 which are laterally spaced on the rear cross beam 28 with the support leg 36 shown spaced inboard from the cross beam juncture with side beam 22 and the support leg 38 located in symmetrical fashion so as to be spaced inboard from the juncture of the cross beam 28 with the side beam 24.

Each of the front and rear upright standards 14 and 16 have a generally inverted U-shape configuration with the front standard including an inclined outboard post 40 and a substantially vertical inboard post 42 with the posts 40 and 42 joined at their upper ends by means of a horizontally extending top rail portion 44 of post 40 extending over the top of its associated vertical post 42 and suitably secured thereto as by welding. In an identical manner the upright rear standard 16 comprises an outboard inclined post 46, an inboard post 48 with the top of vertical post 48 welded to the underside of post 46 top rail portion 50. As seen in FIG. 4, the standards have their posts 40 and 46 lower portions secured to their associated base frame cross beams by the tie bolts 31 while bolts 51 secure the lower ends of posts 42 and 48 to their associated cross beams.

As seen in FIGS. 1 and 2, retractable handle means are provided adjacent the upper end of the rear upright standard 16 which in the form shown is a retractable handle, generally indicated at 52. A pair of handle mounting plates 54 and 56 are suitably secured to the inner end of the handle 52, as by welding, with the plates extending in parallel relation in a forwardly inclined direction with the handle in its raised operative position. In this manner a bifurcated hinge arrangement is provided for reception of the inclined post 46 therebetween with a pivot pin or bolt 58 extending through aligned apertures in the plates 54 and 56, and through the post 46 to provide a transverse pivotal axis for retaining the handle 52 on the post. Thus, it will be seen in FIG. 1 that the handle 52 has a first or dotted line retracted position aligned in juxtaposition with the post 46 and a second solid line or operative position extending longitudinally from the rear standard 16 to allow an operator to grasp the handle 52 and lift upwardly to raise the frame support legs 36 and 38 from the surface 49.

It will be appreciated that upon the raised frame being tilted forwardly it is supported on its pair of casters or wheels 32 and 34 to allow the operator to easily transport the apparatus 10 on the surface 49 to any desired jobsite location. Upon release of the handle 52 it will be gravitationally biased for return to its inoperative dashed line position so as not to interfere with or obstruct the cutting and dispensing mode of operation of the apparatus. By virtue of the wheels being located a predetermined longitudinal distance rearwardly from the front standard 14 the forward portion of the sheet roll 20 acts in a counter-weight manner to provide stabilized, ready wheeled travel of the apparatus.

Turning now to the support means for the roll 20, it will be seen that the sheet roll axle shaft 60 is disposed longitudinally on the inboard side of each of the front and rear upright standards 14 and 16 by means of a pair of front and rear angle brackets 62 and 64, respectively. The front and rear angle brackets 62, 64 are secured to their associated vertical posts 42 and 48 in the same manner which, as seen in FIG. 2, is by welding thereto. The angle brackets 62 and 64 extend laterally in parallel relation with the angles opening upwardly to receive and support opposite ends of the shaft 60. In the preferred form of the invention it will be seen that the longitudinal centerline of the base frame 12 is located in a given vertical plane "X" which is tangent to the inboard sides of the vertical posts 42 and 48. In this manner the front and rear standards are both located entirely on one side of the given vertical symmetrical plane "X" of the frame 12 resulting in the roll shaft 60 disclosed form, from a full roll 20 of maximum diameter on the roll shaft 60. The retaining brake 100 is rotated upwardly away from the edge 90 to its dashed-line position with the sheet material drawn over the raised cutting edge 116, whereby the mentioned acute sheet pull angle "B" is defined. It will be appreciated that when the feed angle "A" and the dispensing angle "B" are substantially equal for a full roll 20 the apparatus provides minimal feed tensioning contact or drag between the rolled feed edge 90 and the sheet material for ease of rotating or unwinding the full roll. As the roll 20 diminishes in diameter the feed angle "A" will progressively decrease causing increased sheet contact with the rolled feed edge 90 to maintain sufficient tension on the sheet material.

Upon the withdrawal of the desired length of material, such as corrugated paper for example, the paper is drawn down on the bearing surface 80 allowing the retaining brake edge 106 to be gravitationally biased into contact with the bearing surface to firmly hold the paper thereon. The operator then rotates the cutting blade 111 in a counter-clockwise first direction into its overcenter solid line position whereby the paper is clamped and tensioned on the bearing surface allowing the operator to cleanly tear or cut off the exact amount of paper needed. Upon the cutting blade being rotated in a clockwise second direction in a snap-action manner to its raised overcenter dashed line position the retainer brake 100 continues to hold the paper cut end in position for its next use by preventing the paper from slipping off the table bearing surface.

It should be noted that by virtue of the novel arrangement of the apparatus the cutting edge 116 makes line contact with the bearing surface 80 of one side of the frame longitudinal centerline of given plane "X" while the roll shaft axle 60 is located on the other side of the longitudinal centerline. Thus, the roll 20 functions to stabilize the apparatus during both its transporting and cutting modes of operation.

What is claimed is:

1. An apparatus for cutting and dispensing sheet material from a roll of sheet material comprising:

a rectangular base frame;

front and rear upright standards mounted on the front and rear ends of said base frame, respectively, in a longitudinally aligned manner;

a cutting and dispensing table assembly extending longitudinally between the upper ends of said front and rear upright standards;

means associated with each said standard to receive and support opposite ends of a sheet roll axle shaft such that said axle shaft is longitudinally disposed intermediate said base frame and said table assembly;

said table assembly including a table having an upper bearing surface including a longitudinally extending feed edge over which a length of sheet material is drawn from a roll supported on said axle shaft;

said table having front and rear support means adjacent each end thereof;

said upright standards being mounted asymmetrically on said base frame entirely on one side of a given vertical plane which includes the longitudinal center line of said base frame, and wherein said receiving and support means being operative to dispose said shaft axle on the inboard side of said front and rear standards substantially on the longitudinal center line of said base frame;

pivotal sheet retaining brake means extending longitudinally between said front and rear support means adjacent said one feed edge operative for rotational gravity biased movement in a first retaining direction toward said one feed edge into an engaged position with said bearing surface with the sheet material from a roll supported on said axle shaft retained therebetween, and said brake means operative for rotational movement in a second sheet material dispensing direction away from said bearing surface one feed edge;

said retaining brake means being in the form of a retaining plate extending longitudinally between said front and rear support means and mounted thereto by pivotal means aligned along its one longitudinal side, said retaining plate including a retaining edge at it other longitudinal side which is operative for rotational movement in said first direction into engagement with said bearing surface;

pivotal sheet cutting blade means extending longitudinally between said front and rear support means operative for resiliently biased, snap-action, rotational movement in either said first or second direction to first cutting and second dispensing overcenter positions;

said blade means first overcenter cutting position resulting in engagement by said blade means with said bearing surface intermediate the bearing surface other longitudinally extending edge and said brake means;

said blade means second overcenter dispensing position locating said blade means a predetermined distance above said bearing surface;

the arrangement characterized in that with said blade means in said second overcenter dispensing position the sheet material, upon being lifted upwardly from said bearing surface operative for releasing said brake means by rotating same in said second dispensing direction allowing a desired length of sheet material to be drawn over said one feed edge onto said bearing surface, with the sheet material being retained thereon by said brake means returning to its engaged position, whereby with said blade means returned to said cutting position, and the desired length of sheet material cut thereby from the roll the cut end is retained by said brake means in a readily accessible manner for the next desired length to be dispensed and cut;

said cutting blade means being in the form of plate means extending longitudinally between said end support means and mounted thereto by pivotal means aligned along an intermediate portion of said plate means, said plate means having a cutting blade portion including a cutting edge at its one longitudinal side for rotational movement in said first or second directions;

said plate means having an overcenter plate portion positioned radially outwardly from its pivotal means in substantially 180° opposed relation to said cutting blade portion, and spring means interconnected between said table and said overcenter plate portion providing said snap-action rotational movement to said first cutting and second dispensing overcenter positions.

2. The apparatus as defined in claim 1, wherein said upper bearing surface extends laterally on either side of said given plane, and said bearing surface feed edge in the form of a rolled edge of defined radius, located a being located in juxtaposition to the given plane. Thus, the roll 20 is located substantially on the longitudinal centerline of the base frame to provide stability of the apparatus in both its portable mode and its cutting and dispensing mode of operation.

Figure 5:
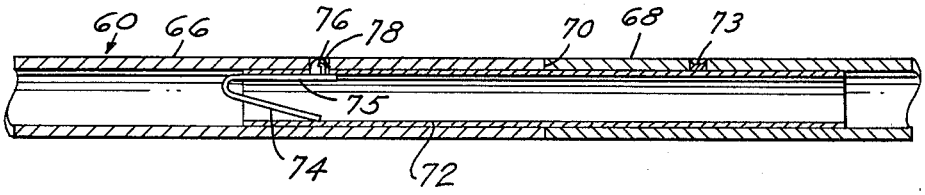
FIG. 5 is a fragmentary enlarged vertical section taken substantially along the line 5—5 of FIG. 4 showing details of the axial shaft coupling arrangement.

As seen in FIG. 1, the shaft 60 includes a front shaft portion 66 including a front handle 67 located on the free end thereof extending forwardly from the front standard 14. The shaft 60 further includes a rear shaft portion 68 having a rear handle 69 extending rearwardly from the rear standard 16. As seen in FIG. 5, the tubular shaft portions 66 and 68 abut at separable joint 70 with the sections 66 and 68 coupled together by means of a connector tube 72 mounted within each opposed open end of the tubular shaft portions. The rear tubular portion 68 is fixedly retained to the connector tube 72 by suitable means, such as by being welded thereto, with one weld being shown at 73.

Releasable locking means are provided between the front tubular shaft portion 66 and the connector tube 72 in the form of a sear-like or angle spring 74 having its upper leaf portion 75 provided with a snap button 76, received in a conforming aperture 78 of the front tube 66. In this manner the shaft tubular sections 66 and 68 are releasably coupled for ready axial disengagement wherein the shaft 60 can be readily separated at its butt joint 70. The two shaft sections 66 and 68 are provided for shipping purposes. By virtue of the disclosed roll mounting arrangement the apparatus can be readily fabricated in various sizes to provide roll widths capacities of 36 inches, 48 inches and 60 inches, for example. Also one large roll or a group of smaller rolls can be easily loaded on shaft 60.

It will thus be seen that upon a full roll being placed on the axle shaft 60 in the above-described manner, the roll can be readily inserted on the frame by being lifted and moved laterally by means of its front and rear shaft handles 67 and 69 so as to contact the inboard side of the vertical tubes 42 and 48 and guided downwardly on the posts onto the angle brackets 62 and 64.

Figure 3:
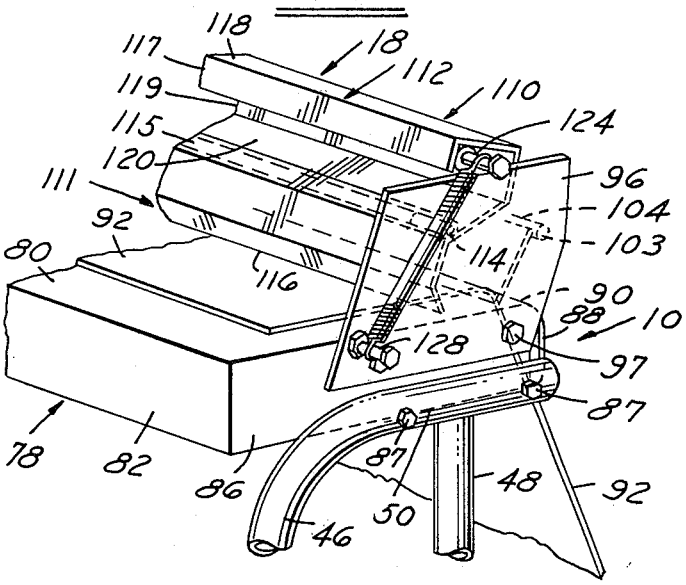
FIG. 3 is a fragmentary prospective view of the upper cutting table assembly of the present invention.

FIGS. 2 and 3 depict the cutting table assembly 18 including a rigid box-like table having an upper bearing surface 80 formed on a substantially rectangular top plate 78 having an outer side flange 82 terminating in a return flange 83, extending longitudinally, and transverse end flanges 84 and 86. Each end flange is suitably secured to the associated rail portions 44 and 50 of the front and rear upright standards 14 and 16 respectively, by bolts 85 and 87 to fixedly retain the table as a structural frame member between the standards. The table further includes an inboard or inner longitudinally extending flange 88 having an upper arcuate sheet lead-in or rolled feed edge portion 90 over which the roll sheet material is fed or drawn prior to being retained on the bearing surface 80.

In FIG. 1 a pair of front and rear end support means in the form of end plates are shown at 94 and 96 respectively, and face on their associated table end flanges 84 and 86 so as to extend vertically upwardly while being suitably supported to the end flanges such as by bolts 97.

With reference to FIG. 2, it will be seen that a sheet material retaining brake means or plate-like brake 100 is pivotally supported along its one longitudinal side by first longitudinally aligned pivot means in the form of aligned studs 102 and 103 fixedly mounted on the inner surface of each support plate. The studs 102 and 103 are telescoped into each end of a pivot tube 104 welded to one longitudinal side of brake 100, defining a first pivotal retainer brake axis. The retainer brake 100 includes a retaining edge 106 at its other longitudinal side which is gravity biased for rotational movement in a first direction toward rolled feed edge 90 for engagement with the bearing surface 80 along a first line contact. FIG. 2 denotes that the first line contact is parallel to and substantially vertically aligned on the axis of the roll axle shaft 60 so as to be positioned on one side of the frame centerline lying in given plane "X". It will be noted that the retaining brake 100 is pivotal about the axis of its hinge studs 102 and 103 so as to be rotated upwardly away from the rolled feed edge 90 to its dashed-line position upon the sheet material on bearing surface 80 being lifted upwardly to its maximum "B" pull angle position 93, to be discussed.

As seen in FIGS. 2 and 3, pivotal cutting blade means or plate means, generally indicated at 110, includes a cutting blade portion 111 and an over center plate portion 112. The plate means 110 extend longitudinally between the end supports and are pivotally mounted thereto by second pivot means aligned along an intermitent portion of the plate means 110. The cutting blade means 110 second pivotal axis is defined by pivot studs 113 and 114 having a pivot tube 115, welded to an intermediate portion of the blade means 110 and arranged with its opposite ends telescoped over an associated pivot stud 113, 114. The cutting blade portion 111 includes a cutting edge 116 at its other longitudinal side operative for rotational movement in a first direction into engagement with the bearing surface 80 along a second line contact located on the outboard side of the given vertical plane "X".

The cutting blade means 110 includes an overcenter plate portion 112 having a channel-shaped free end defined by flanges 117, 118 and 119 joined to the blade portion 111 by intermediate pivot tube mounting portion 120. The channel-shaped portion supports therein pivotal connector means in the form of a pair of longitudinally extending pins or bolts 122 and 124 extending longitudinally outwardly from each end of the cutting blade means 110. Each of the front and rear support plates 94 and 96 includes a fixed pivotal connector means in the form of bolts 126 and 128 respectively. Overcenter resilient biasing means are provided in the form of front and rear coil tension springs 130 and 132. The front spring 130 is operative to be secured between its associated connector bolts 122 and 126 while the front coil tension spring 132 is connected between its associated connector bolts 124 and 128.

The blade means 110 pivots about the axis of studs 113 and 114 from a first solid line overcenter, snap-action cutting position wherein its cutting edge 116 contacts the bearing surface 80, with the sheet material interposed therebetween, to a second dashed line overcenter, snap-action raised dispensing position wherein the cutting edge 116 is located a defined distance above the bearing surface 80. In its maximum raised position indicated by dashed line 93 the tensioned sheet material contacts edge 116 to define a sheet material maximum dispensing or pull angle "B" of the order of 15° from the horizontal bearing surface 80.

As seen in FIG. 2 with the blade cutting edge 116 in its raised overcenter position the sheet material is reeled from the roll 20 and fed upwardly so as to be drawn over the bearing surface rolled feed edge 90. It will be noted that the sheet portion 92 is inclined upwardly toward the feed edge 90 at a predetermined maximum acute feed angle "A" from the vertical, about 15° in the predetermined distance on the other side of said given plane, the arrangement characterized in that the sheet material from a full roll of initial predetermined diameter, upon being drawn upwardly from the roll over said feed edge, is inclined upwardly toward said feed edge at a predetermined initial maximum acute feed angle from the vertical;

the sheet material, upon being lifted upwardly from said bearing surface and pulled from the roll so as to be drawn concurrently over both said feed edge and said cutting edge in its said second overcenter dispensing position defining a predetermined maximum acute dispensing angle with said bearing surface, whereby said maximum feed angle and said maximum dispensing angle are initially substantially equal, resulting in minimal initial contact between the sheet material and said bearing surface feed edge for ready dispensing from a full roll of heavy sheet material.

3. The apparatus as defined in claim 1, wherein a pair of support wheels carried on said frame located on a common transverse axis spaced a predetermined distance from the front end of said frame;

fixed support members depending from the rear portion of said frame, and handle means carried adjacent the upper end of said rear upright standard for selectively raising and lowering said support members from a surface to provide a first transportable mode and a second cutting and dispensing mode, respectively, for said apparatus.

4. The apparatus as defined in claim 3, wherein said handle means the form of a retractable handle pivotally supported to said rear upright standard or a transverse axis; said handle being gravitationally biased so as to automatically rotate from a first operative transportable mode wherein said handle extends longitudinally rearwardly, to a second rest cutting and dispensing mode, wherein said handle extends downwardly in juxtaposition to said rear upright standard.

5. The apparatus as defined in claim 1, wherein said roll axle shafts extends longitudinally from each end of the roll a predetermined distance to provide handle portions at each end thereof to permit ease of roll replacement on said standards.

6. The apparatus as defined in claim 1, wherein said axle shaft in the form of a pair tubular members which are joined at an intermediate separable joint, one of said members having a reduced shank portion of a size so as to be received in a slidable telescoping manner within the remaining member, and resilient locking means provided in said shank portion and biased in a radially outwardly manner to engage said remaining member preventing separation of said members upon a roll of sheet material being supported by said shaft on said upright standards.

7. A wheelable apparatus for transporting, cutting and dispensing heavy sheet rolls of material comprising:

a rectangular base frame having a pair of longitudinally extending side beams and a pair of laterally extending front and rear cross beams;

front and rear upright standard mounted, respectively, on said front and rear cross beams in longitudinally aligned asymmetrical manner;

a support wheel carried on each side beam with the wheels located on a common transverse axis spaced a predetermined distance from said front cross beam;

fixed support members depending from the rear portion of said base frame;

handle means carried adjacent the upper end of said rear upright standard for selectively raising and lowering said support members from a surface to provide a first transportable mode and a second cutting and dispensing mode respectively, for said apparatus;

a cutting and dispensing table assembly extending longitudinally between the upper ends of said front and rear standards;

means associated with each said front and rear standards to receive and support opposite ends of a sheet roll axle shaft, intermediate said base frame and said table assembly;

said cutting table assembly including a table having an upper bearing surface over which a length of sheet material extends after it is reeled off a roll supported on said axle shaft;

said table having front and rear support means adjacent each end thereof;

said upright standards are mounted in longitudinally aligned relation entirely on one side of a given vertical plane which includes the longitudinal centerline of said base frame, and wherein said shaft axle receiving and support means being operative to position said shaft axle on the inboard side of said front and rear standards substantially on the longitudinal centerline of said base frame;

pivotal sheet retaining brake means extending longitudinally between said front and rear support means operative for rotational, gravitationally biased movement in a first retaining direction into engagement with said bearing surface and operative for rotational movement in a second dispensing direction away from said bearing surface;

pivotal cutting blade means extending longitudinally between said front and rear support means operative for selective, resiliently biased, snap-action rotational movement in either said first or second directions to first cutting and second dispensing overcenter positions;

said blade means first overcenter position resulting in engagement with said bearing surface with sheet material from the roll positioned therebetween; thereby permitting the tearing off of the desired length of sheet material from the roll with said brake means retaining the sheet torn end on said bearing surface.

8. The apparatus as defined in claim 7, wherein said handle means in the form of a retractable handle pivotally supported to said rear upright standard on a transverse axis, said handle being gravitationally biased so as to automatically rotate from said first transportable mode, wherein said handle extends longitudinally rearwardly, to said second cutting and dispensing mode, wherein said handle extends downwardly in juxtaposition to said rear upright standard.

9. The apparatus as defined in claim 7, wherein said fixed support members in the form of a pair of support legs depending from said rear cross beam, said legs being symmetrically spaced on either side of the frame longitudinal centerline a predetermined distance inboard from their associated side beam.

10. The apparatus as defined in claim 7, wherein said roll axle shaft extends longitudinally from each end of the roll a predetermined distance to provide handle portions at each end thereof permitting ease of roll replacement on said standards.

* * * * *